US006891509B2

(12) United States Patent
Rose et al.

(10) Patent No.: US 6,891,509 B2
(45) Date of Patent: May 10, 2005

(54) ANTENNA ASSEMBLY

(75) Inventors: Ian G Rose, Stowmarket (GB); William H Dobbie, Ipswich (GB)

(73) Assignee: British Telecommunications plc, London (GB)

( * ) Notice: Subject to any disclaimer, the term of this patent is extended or adjusted under 35 U.S.C. 154(b) by 0 days.

(21) Appl. No.: 10/380,530

(22) PCT Filed: Sep. 5, 2001

(86) PCT No.: PCT/GB01/03983

§ 371 (c)(1),
(2), (4) Date: Mar. 17, 2003

(87) PCT Pub. No.: WO02/27863

PCT Pub. Date: Apr. 4, 2002

(65) Prior Publication Data

US 2004/0012532 A1 Jan. 22, 2004

(30) Foreign Application Priority Data

Sep. 29, 2000 (EP) ..... 00308585

(51) Int. Cl.[7] ..... H01Q 3/02; H01A 3/00

(52) U.S. Cl. ..... 343/758; 343/882

(58) Field of Search ..... 343/757, 758, 343/763, 882, 853, DIG. 2, 915, 705, 890, 893

(56) References Cited

U.S. PATENT DOCUMENTS 5,086,304 A * 2/1992 Collins ..... 343/778
6,310,582 B1 * 10/2001 Uetake et al. ..... 343/765

* cited by examiner

*Primary Examiner*—James Vannucci
(74) *Attorney, Agent, or Firm*—Nixon & Vanderhye PC

(57) ABSTRACT

An assembly of mechanically steerable directional radio antennas, comprising a primary antenna and at least one secondary antenna, arranged such that the or each secondary antenna is capable of being physically steered over a limited azimuthal arc relative to the primary antenna, and is at least partially within the swept volume of the primary antenna. By allowing the swept volumes of the antennas to overlap, a compact assembly can be provided, while by limiting the azimuthal movement of the secondary antennas relative to the primary, it can be arranged that the antennas do not foul each other.

10 Claims, 4 Drawing Sheets

ANTENNA ASSEMBLY

This application is the US national phase of international application PCT/GB01/03983 filed 5 Sep. 2001 which designated the U.S.

BACKGROUND OF THE INVENTION

1. Field of the Invention

This invention relates to radio antennas, and in particular to directional antennas arranged for point to point communication. Various proposals have been made for local microwave distribution systems, in which generally a central node is connected by a fixed cable (optical fibre or conventionally wired), or by other means, to other switched or packet systems, the central node acting as a distribution point from which a large number of end users can be served by microwave links.

2. Related Art

Such systems have been proposed for many years: see for example an article 29 *GHz Point to Point Radio Systems for Local Distribution* by S Mohamed and M Pilgrim in the *British Telecommunications Technology Journal* Vol2, No 1 (January 1984). Generally, each end user employs a directional antenna aimed at a corresponding antenna at the central node. In certain cases one end user's installation may act as a relay station to allow communication between the central node and a second end user which is out of range of the central node (typical range for a 40 GHz transmitter is of the order of 2 km), or does not have an unobstructed line of sight to the central node.

More recent proposals have extended this principle to develop a "mesh" system, in which only a few base stations are required and the user stations are connected to their nearest base station through one or more such relays. Such a system is illustrated in International Patent Specification WO98/27694. To provide multiple routing for packet data systems, and for sufficient robustness to the system in the event of a user station ceasing to operate, either temporarily as the result of a system failure or permanently (for example should the user no longer wish to use the service), each user station is provided with several antennas for provision of links with several neighbouring user stations. The mesh may be served by more than one base station, as shown in FIG. 1.

When a new user station is to be connected to the network, the connectivity of the mesh has to be changed to accommodate it. This requires re-alignment of the the directional antennas of some of the neighbouring stations, so that the new station can be connected into the mesh. Similarly, if a station is taken out of service, antennas on neighbouring stations may have to be redirected. It is envisaged that such redirection be carried out by the network operator remotely, rather than requiring a site visit.

One way to achieve this is disclosed in International Patent Application WO 99/65162, in which an fixed array of thirty-two directional antennas is provided. Each antenna is aligned in a different azimuthal direction. The antennas are switched on or off according to the current requirements of the mesh network. Several adjacent antennas can be used together as a phased array. This system is somewhat cumbersome as it requires space for a large number of antennas, only a few of which are in use at any one time. An alternative arrangement shown in International Patent Application WO 99/65105 uses a remotely controlled mechanically steerable antenna. This reduces the volume of the installation. However, in order to act as a relay the station must have more than one such antenna, each independently controlled. To avoid fouling each other, each antenna would have to be mounted in a volume clear of the other antennas' swept volumes. The simplest arrangement is a vertical stack of such antennas, each rotatable about a common vertical axis. However, such an arrangement is cumbersome, and its size and weight makes rooftop installation difficult. It is desirable to minimise the size of such equipment for reasons of materials costs, wind loading, simplicity of installation, and aesthetics.

BRIEF SUMMARY OF THE INVENTION

According to the invention, there is provided an assembly of mechanically steerable directional radio antennas, comprising a primary antenna and at least one secondary antenna, arranged such that the or each secondary antenna is capable of being physically steered over a limited azimuthal arc relative to the primary antenna, and is at least partially within the volume swept by the primary antenna. By allowing the swept volumes of the antennas to overlap, a compact assembly can be provided, whilst by limiting the azimuthal movement of the secondary antennas relative to the primary, it can be arranged that the antennas do not foul each other.

In a preferred arrangement, some of the secondary antennas may be vertically offset from each other. In some of the embodiments to be described, the secondary antennas rotate about the same vertical axis as the primary antenna, whilst in the other their axes of rotation are parallel.

The secondary antennas may be plate antennas, such as flat plate array antennas, which carry printed, etched, machined or other radiative elements, each arranged to move over part of the circumference of the swept volume of the primary antenna. The primary antenna may also be a plate antenna, or a horn antenna. The swept volumes of two or more of the secondary antennas may overlap.

DESCRIPTION OF THE DRAWINGS

Four embodiments of the invention will now be described, by way of example only, with reference to the drawings in which:

FIG. 3 is a schematic sectional plan view of the antenna assembly of FIG. 2:

DETAILED DESCRIPTION OF EXEMPLARY EMBODIMENTS

Figure 1:
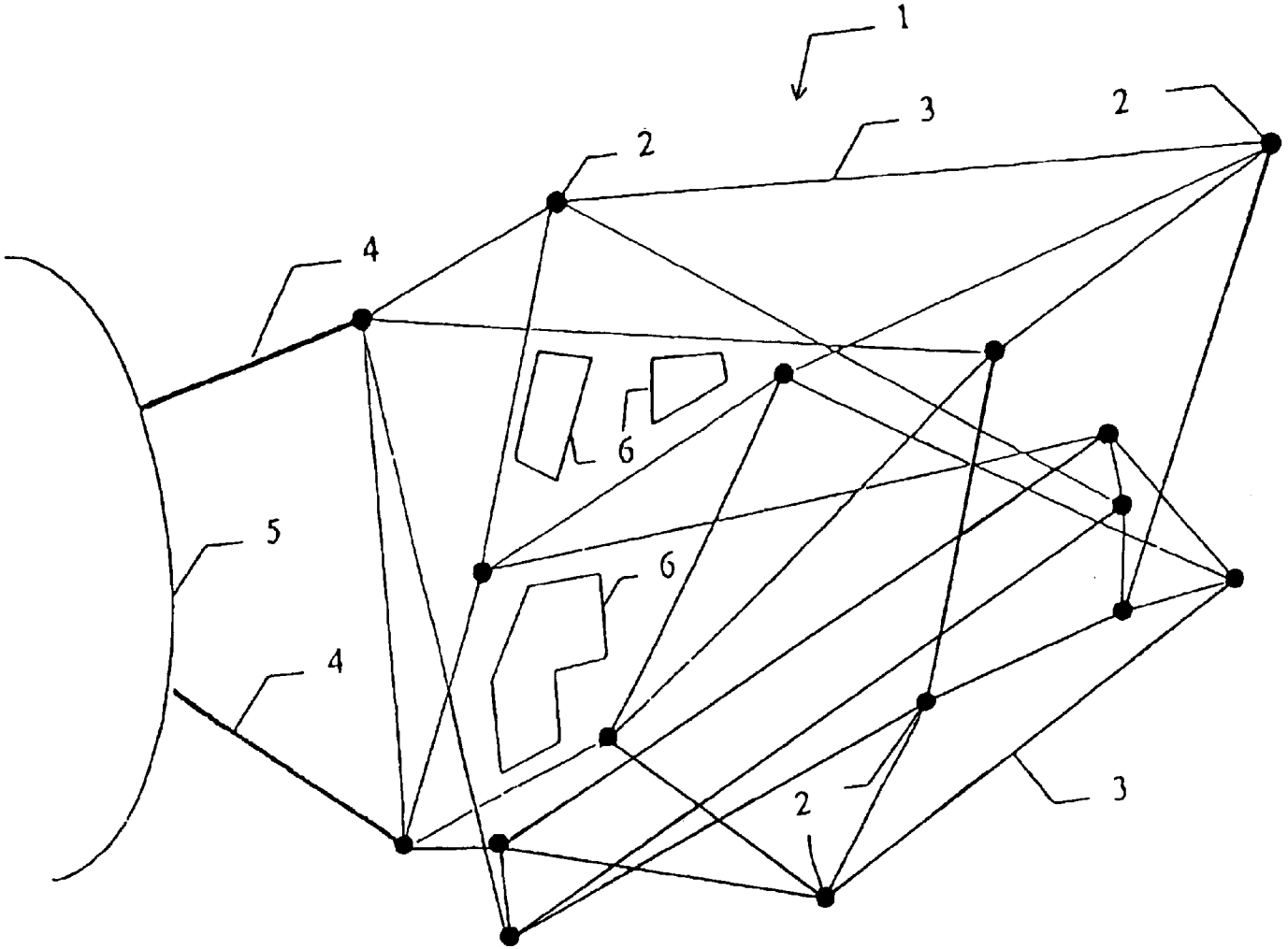
FIG. 1 is a schematic illustration of a microwave distribution mesh system of the kind for which this invention is intended for use.

FIG. 1, which is a reproduction of a Figure from International Patent Specification WO98/27694, shows a simple example of a network of the kind for which the present invention is intended for use. In the example shown, there are sixteen subscribers or users, each of which is associated with a network node 2. Each node 2 has a radio transceiver unit which is able to transmit and receive high frequency radio signals, for example between 1 GHz to 40 GHz or more. The transceiver unit of each node 2 is in direct line-of-sight contact with several other similar units at other respective nodes 2 by direct line-of-sight wireless links 3. It can be seen from FIG. 1 that the nodes 2 of the network 1 can communicate with each other either directly, or by way of other nodes if necessary to avoid buildings 6 or other obstructions which otherwise block direct line-of-sight connection between particular nodes 2, or to overcome the limited range of transmitters working at these frequencies. A message from any one node 2 to any other node 2 will typically traverse several links 3 in a series of "hops" across the system 1. Interconnect trunks 4 connect specified nodes 2 to a trunk network 5.

Each node 2 is provided with at least the same number of antennas as there are links 3 associated with that node 2. To allow reconfiguration of the network as nodes 2 or obstructions 6 are added or removed from the system 1 the nodes are provided with the capability to adjust the directions of their associated links. In one arrangement discussed in the prior art reference WO98/27694, an array of fixed antennas is provided, the appropriate antenna for each link 3 required being switched in as required. Such an arrangement requires a much larger number of antennas to be provided at each node than are actually needed at any one time, significantly increasing the bulk and capital cost of the node installation. In alternative arrangements a smaller number of independently steerable antennas are provided. The steering may be electrical (that is, by controlling the electrical characteristics of the antenna to control the effective boresight direction) or by physical movement of the antenna. It is of course possible for different nodes 2 to use different types of antenna assembly.

To obtain optimum use of the radio spectrum and minimise the amount of equipment required at each node, the antennas at a given node 2 may share a single transceiver, using any known multiplexing technique to serve all the links 3 from the one node 2.

Figure 2:
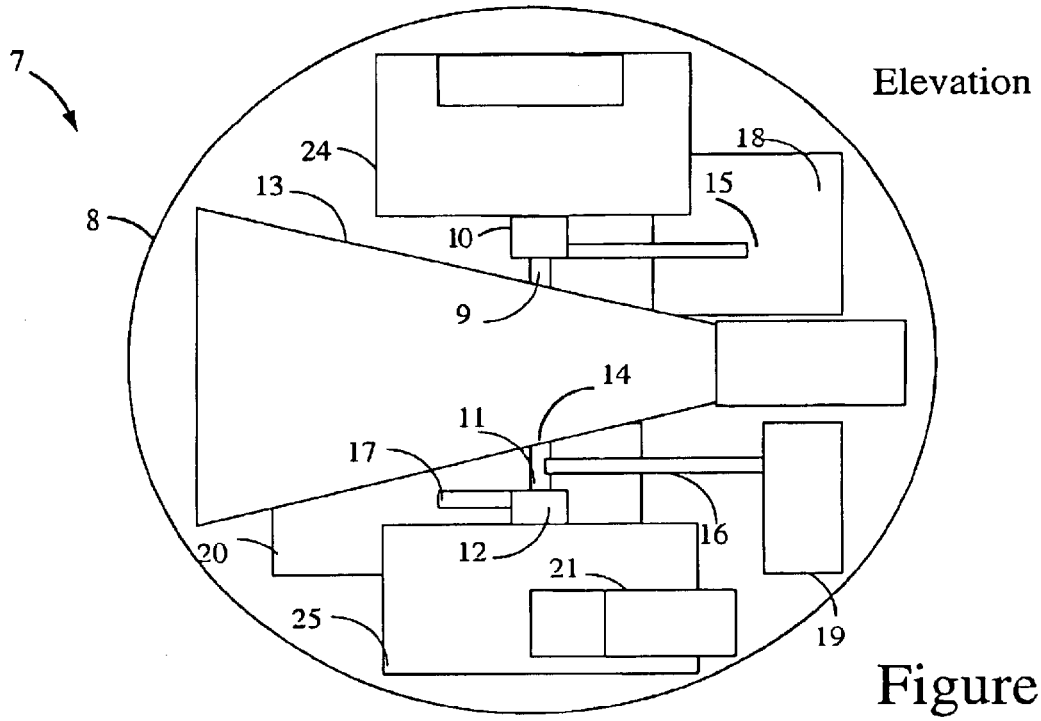
FIGS. 2 and 3 are respectively a schematic sectional elevation and plan view of an antenna assembly according to a first embodiment of the invention.
Figure 3:
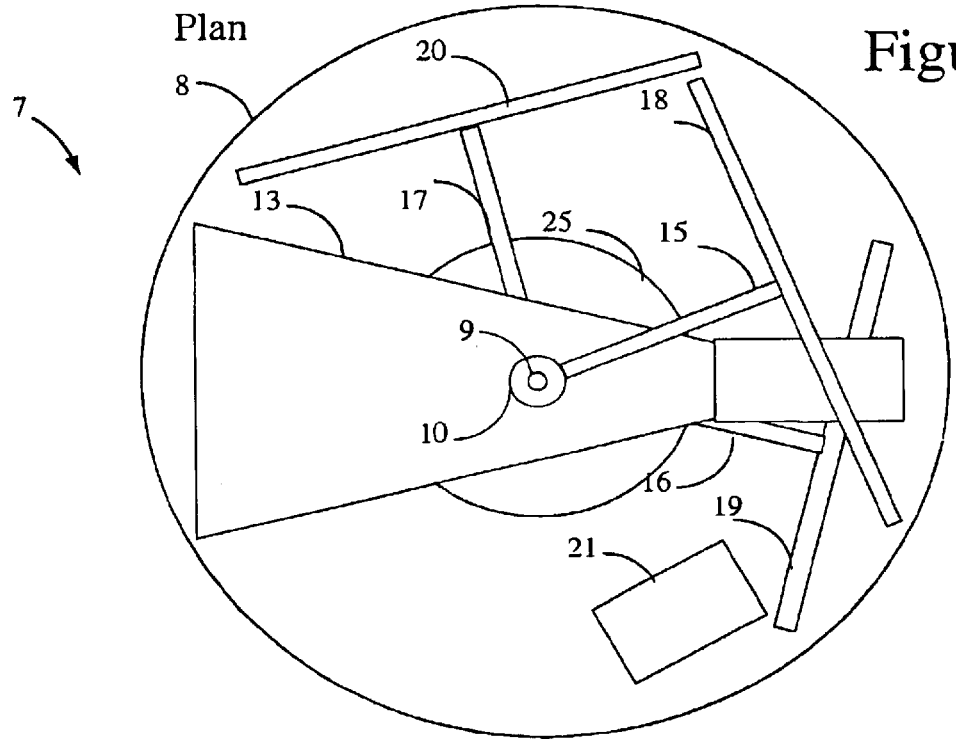

FIGS. 2 and 3 show schematically an antenna assembly 7 according to the invention, for use at one or more of the nodes 2 of such a network. FIG. 2 is an elevation, and FIG. 3 is a plan view. Both Figures show part of the outer housing removed, and FIG. 3 also has one of the motor assemblies removed. Electrical connections are also omitted from both Figures for clarity.

The antenna assembly 7 has an outer housing 8, transparent to radio waves, provided to protect the components within from the weather, and to provide an aesthetically unobtrusive appearance. In this embodiment the housing is spherical, but other shapes may also be employed. It may be secured to a building or other structure by any suitable means, from which it may also obtain its power supply.

Mounted within the upper part of the housing 8 are two concentric spindles 9, 10 extending vertically downwards, whilst in the lower part of the assembly two further concentric spindles 11, 12 extend vertically upwards.

The inner spindle 9 of the upper pair is connected to the horn 13 of a directional antenna, such that the horn 13 can be turned to any selected azimuthal orientation, to establish radio contact with a directional antenna at another node 2. The rotational freedom of the horn 13 defines a cylindrical swept volume, having a diameter equal to the length of the horn antenna, (including the associated waveguide), a height equal to the height of the horn, and a vertical axis defined by the spindle 9. The inner spindle 11 of the lower pair ends in a bearing 14 supporting the horn 13. The dimensions of the housing 8 are largely constrained by the size of the antenna horn.

The other spindles 10, 11, 12 are each connected by a respective spacer arm 15, 16, 17 to a respective flat plate antenna 18, 19, 20. These antennas are mounted at least partially within the swept volume of the horn 13, but their movements are limited such that they do not foul the horn 13 itself. The flat plate antennas 18, 19, 20 can all move in azimuth through approximately 270°, relative to the position of the horn 13, being prevented by the horn 13 itself from occupying a position less than 45° either side of the boresight of the horn. In the embodiment depicted the two flat plate antennas 19, 20 connected to the lower spindles 11, 12 both have the same vertical extent, and therefore are further constrained not to occupy positions within 45° of each other.

Electrical connections (not shown) are provided between each antenna 13, 18, 19, 20 and a transceiver 21, which may be located within the housing 8 as shown or elsewhere. The transceiver 21 relays signals between the antennas 13, 18, 19, 20 in its function as a node 2 of the network 1, and also has a feed to and from the user terminal associated with the node 2. The user terminal will typically be within the building upon which the antenna assembly 7 is mounted. The assembly 7 may also obtain its power supply from the building, or from a self contained system such as solar panels mounted on the upper part of the housing 8 where they will not obstruct the passage of radio signals to and from the antennas 13, 18, 19, 20.

An assembly of antennas of this kind could be aligned by hand. However, antenna assemblies are typically located in elevated locations which are difficult of access. Moreover, to establish a new link 3 requires simultaneous alignment of antennas at two separate nodes 2. To avoid the need for site visits, it is therefore preferred to align the antennas by remote control. A control system 23 (shown in FIG. 4) is therefore provided for controlling the positions of the directional antennas 13, 18, 19, 20, by means of motors 24, 25 mounted in the housing 8 and capable of driving the spindles 9, 10, 11, 12 to move the antennas 13, 18, 19, 20 relative to the housing 8. Each spindle 9, 10, 11, 12 can be driven independently of the others. As shown in FIG. 2, the upper spindles 9, 10 can be driven by an upper motor assembly 24, and the lower spindles 11, 12 by a lower motor assembly 25. The upper motor assembly 24 may comprise a separate electric motor for each spindle 9, 10, or a single motor may be provided whose output spindle can be selectively connected to either spindle 9, 10. The connections between the lower motor assembly 25 and the lower spindles 11, 12 are similar. It will be appreciated that suitable mechanical connections may be used to allow a single motor to selectively drive any of the spindles 9, 10, 11, 12.

Control may be achieved by radio signals received from the network controller through one or more of the directional antennas 13, 18, 19, 20. However, before initial installation or reconfiguration is performed, it is likely that none of the directional antennas will be aimed towards a transmitter from which such control signals can be received, so it is preferred that the control signals are transmitted to the user terminal by an alternative telephone system, such as the public switched telephone network (PSTN), and then to the antenna control system 23 by means of the user connection. If a fixed PSTN connection is not available, an omnidirectional antenna may be provided to receive control radio signals, for example to a cellular telephone integrated in the control system 23. When the network 1 is to be reconfigured, either on installation of the node 2 or subsequently on changes to other nodes, the network operator transmits coarse control signals to the control system 23 of the antenna assembly, causing the motors in the motor assemblies to move the antennas 13, 18, 19, 20 into the required positions. The angular constraints on the movement of the antennas may be programmed into the control systems of the network operator, to prevent the network operator commanding an incompatible set of orientations. Alternatively, the required directions may be specified by the network operator, the control system 23 selecting which antenna to aim in each specified direction according to constraints programmed into the control system 23 itself. Automated techniques for acquisition of neighbouring nodes are also possible.

Fine control of the antennas' positions can be carried out by any suitable means, such as by transmitting a signal from the antenna at one end of a link 3 to the antenna at the other end, and moving both antennas co-operatively to optimise the received signal.

The performance of the antennas 13, 18, 19, 20 may differ because of their different designs. The choice of which antenna to use for each link 3 can be made to optimise the overall quality of the network 1, for example by using the most powerful antenna at a given node 2 for the link 3 with most attenuation.

Figure 4:
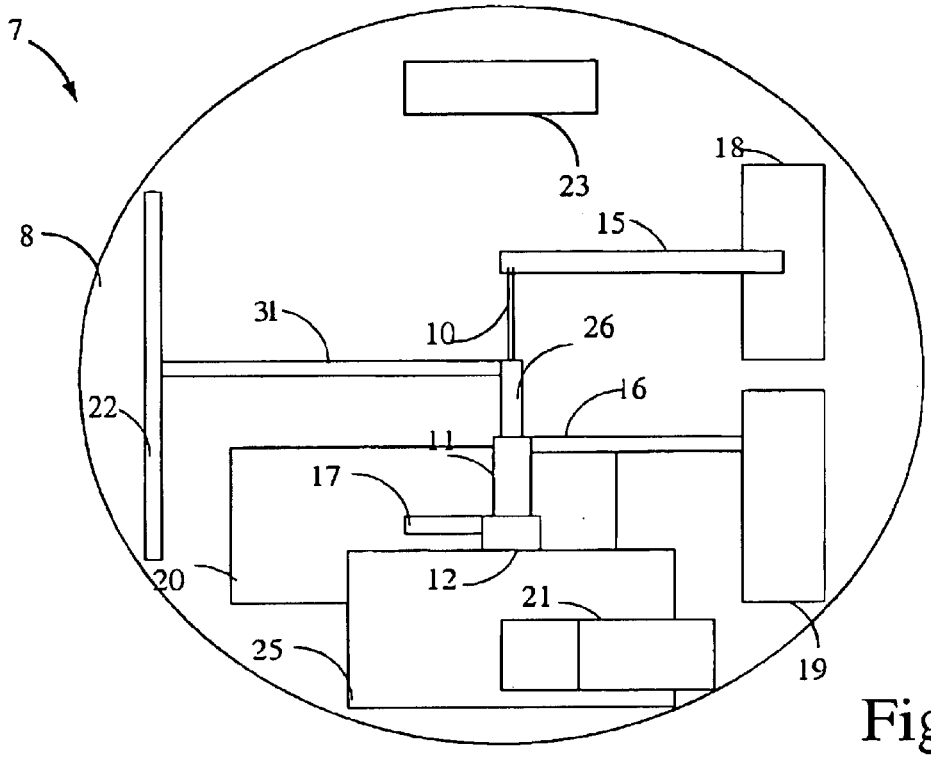
FIG. 4 is a schematic sectional elevation of an antenna assembly according to a second embodiment of the invention.

In the embodiment depicted in FIGS. 2 and 3, the assembly comprises one horn antenna 13 and three flat plate antennas 18, 19, 20. However, this is not to be taken as limitative. Alternative configurations with more or fewer antennas, or with different types of antennas, fall within the scope of the claims. For example, the horn antenna 13 may be replaced by a further flat plate antenna 22 as shown in FIG. 4. This embodiment is similar to that of FIGS. 2 and 3 in other respects, and corresponding elements are given the same reference numerals. In this embodiment all the antennas 22, 18, 19, 20, are driven from a single motor assembly 25 through respective concentric spindles 9, 10, 11, 12 to which they are connected by respective spacers 31, 15, 16, 17.

The sizes of the antennas may be varied to improve gain, but because their swept areas overlap any increase in size will limit the angle through which they can move relative to each other without fouling.

Figure 5:
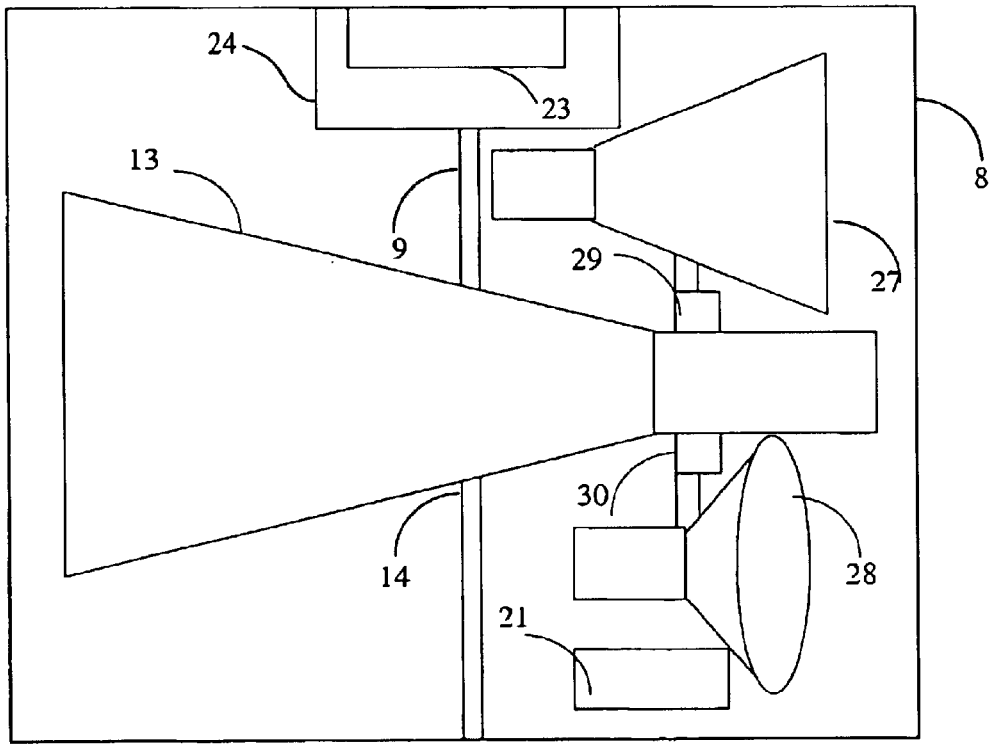
FIG. 5 is a schematic sectional elevation of an antenna assembly according to a third embodiment of the invention

In an alternative configuration shown in FIG. 5, in which components equivalent to those in FIGS. 2 and 3 again have the same reference numerals, first and second horn antennas 27, 28 are mounted on the main horn antenna 13, arranged for relative rotational movement of the first and second antennas 27, 28 at least partially within the swept volume of the main antenna 13. This simplifies the control system, as the mountings can be designed to prevent fouling movements, but makes electrical connection more complex, and requires a complex drive train if more than one antenna is to be driven by the same motor. In this embodiment, each antenna 13, 27, 28 has its own motor 24, 29, 30.

Figure 6:
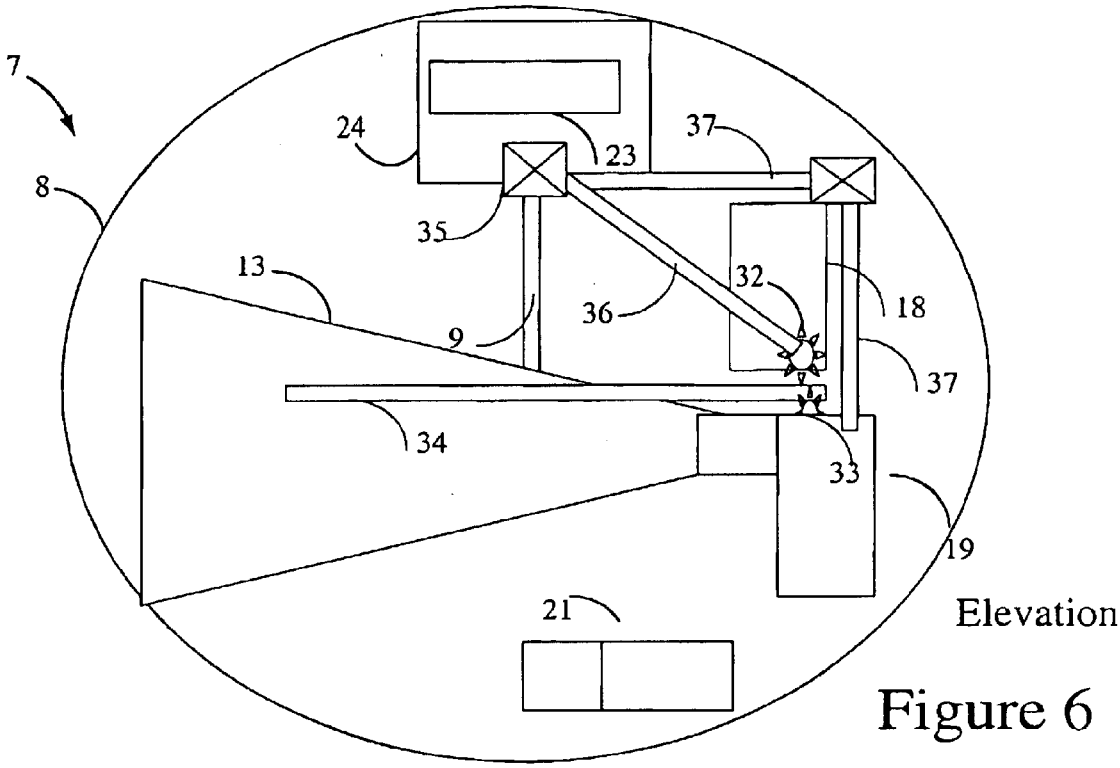
FIGS. 6 and 7 are respectively a schematic sectional elevation and plan view of an antenna assembly according to a fourth embodiment of the invention.
Figure 7:
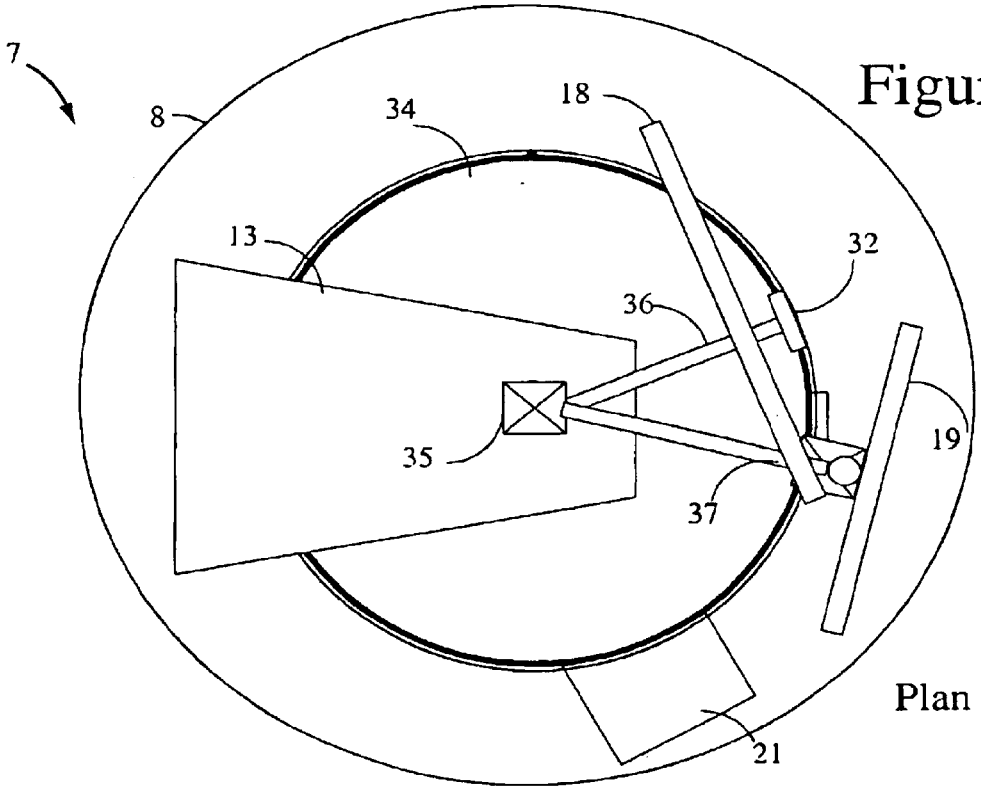

In a further configuration shown in FIGS. 6 and 7, the arrangement of FIGS. 2 and 3 is modified by arranging that the flat antennas 18, 19 (for clarity, only two are shown) are driven by respective gear wheels 32, 33 along a curved toothed track 34 mounted on the horn antenna 13. The gear wheels 32, 33 can be selectively driven from a gearbox 35 through respective drive trains 36, 37, for relative movement between the flat antennas 18, 19 and the track 34 and hence the horn antenna 13. The control unit 23 controls the gearbox 35 to select which drive train is to be driven from the motor 24. The drive trains 36, 37 may be replaced by separate electric motions, each driving a respective wheel 32, 33.

What is claimed is:

1. An assembly of mechanically steerable directional radio antennas, comprising a primary steerable antenna and at least one secondary steerable antenna, the secondary steerable antenna mounted such as to be physically steerable over a horizontal arc relative to the primary antenna, and is at least partially within the volume swept by the primary steerable antenna, wherein two of the antennas are separately mounted at positions vertically displaced from each other on spindles having a common vertical axis.

2. An assembly according to claim 1, wherein at least one secondary antenna is mounted on the primary antenna.

3. An assembly according to claim 1, wherein at least one of the antennas is a plate antenna.

4. An assembly according to claim 1, wherein at least one of the antennas is a horn antenna.

5. An assembly according to claim 1, wherein the swept volumes of two or more secondary antennas partially overlap.

6. An assembly according to claim 1, further comprising control means for controlling movement of the antennas.

7. An assembly according to claim 6, wherein the control means comprises powered means for moving the antennas.

8. An assembly according to claim 6, wherein the control means comprises means for receiving control instructions from a remote source.

9. An assembly according to claim 1, further comprising a housing enclosing the assembly, the dimensions of at least the primary antenna extending across substantially the full width of the housing.

10. An assembly according to claim 9, in which at least one antenna is mounted on a spindle extending from the top of the housing, and at least one antenna is mounted on another spindle having the same axis extending from the bottom of the housing.

* * * * *